United States Patent [19]

Kagawa

[11] Patent Number: 4,641,265

[45] Date of Patent: Feb. 3, 1987

[54] SYSTEM FOR CONTROLLING THE PROPORTION OF LEAF VEIN IN TOBACCO RAW MATERIAL TREATING PROCESS

[75] Inventor: Kenichi Kagawa, Hiratsuka, Japan

[73] Assignee: Japan Tobacco Inc., Tokyo, Japan

[21] Appl. No.: 635,274

[22] Filed: Jul. 27, 1984

[30] Foreign Application Priority Data

Jul. 27, 1983 [JP] Japan ..... 58-135784

[51] Int. Cl.[4] ..... G05B 13/02; A24B 5/10; G06F 15/46

[52] U.S. Cl. ..... 364/153; 364/152; 364/469; 131/312

[58] Field of Search ..... 364/153, 152, 468, 469, 364/470, 471; 131/312, 311, 109.1

[56] References Cited

U.S. PATENT DOCUMENTS

| | | | |
|---|---|---|---|
| 3,309,507 | 3/1967 | Schlein | 364/152 |
| 4,045,657 | 8/1977 | Falke | 364/469 |
| 4,214,300 | 7/1980 | Baslow et al. | 364/152 |
| 4,323,083 | 4/1982 | Cogbill, II | 131/312 |

*Primary Examiner*—Jerry Smith
*Assistant Examiner*—John R. Lastova
*Attorney, Agent, or Firm*—Shlesinger Arkwright Garvey & Fado

[57] ABSTRACT

A new system for controlling the proportion of leaf vein in a tobacco raw material treating process is provided. In general, the process involves feeding a raw leaf tobacco to a humidity controller to impart thereto moisture and temperature necessary for the removal of leaf vein, then peeling off the leaf tobacco into lamina and leaf vein by leaf vein removing means and subsequently separating the lamina and leaf vein from each other by winnowing means. The new system includes means for measuring the flow rate of the raw leaf tobacco; means for measuring the moisture content of the leaf tobacco moistened by said humidity controller; sampling switching means for selecting by switching the lamina from which winnowing means in said raw material treating process is to be sampled for measuring the proportion of leaf vein; means for measuring the proportion of leaf vein in the lamina samples by said sampling switching means; and arithmetic controller means for inputting the results of measurement from said flow rate measuring means and said moisture content measuring means, calculating an optimum air velocity for the winnowing means in said raw material treating process so that the proportion of leaf vein is within the range of a preset value and controlling the winnowing means on the basis of the calculated value, and at the same time inputting as a feedback signal the result of measurement from said leaf vein proportion measuring means and correcting said calculated value in accordance with said feedback signal.

6 Claims, 7 Drawing Figures

(a)

(b)

(c)

| | Winnower | |
|---|---|---|
| | 6 | 16 |
| —o— | 0.2 % | 1.0 % |
| —×— | 0.4 % | 0.8 % |
| —△— | 0.7 % | 0.4 % |

SYSTEM FOR CONTROLLING THE PROPORTION OF LEAF VEIN IN TOBACCO RAW MATERIAL TREATING PROCESS

BACKGROUND OF THE INVENTION

The present invention relates to a system for controlling the proportion of leaf vein in a tobacco raw material treating process.

Generally, in a tobacco manufacturing process, a raw leaf tobacco is first unfastened leaf by leaf, then softened with water and steam by means of a humidity controller, thereafter peeled off into a mesophyll portion (hereinafter referred to as "lamina") and a leaf vein portion (hereinafter referred to as "vein") by vein removing means and separated into lamina and vein by separator means. The lamina is dried to a moisture content of 12% so as to not to cause deterioration or the growth of mold during a long term storage and packed into a cask or other container (the process described so far is a raw material treating process), then stored for aging over a long period. After aging, the lamina is shredded into shred tobacco.

Thus, in the raw material treating process the leaf tobacco is peeled off into lamina and vein by vein removing means and then separated into lamina and vein by separator means. In this case, the degree of the separation greatly affects the yield and quality of product. More particularly, if the separation is performed so as not to incorporate vein in lamina, the quality of product will be improved, but a considerable quantity of lamina will remain on the vein side at the time of separation, thus leading to a very poor yield. On the other hand, if the vein is allowed to remain in the lamina at the time of separation, the yield will be improved, but the quality of product is severely deteriorated. Therefore, it is necessary to suitably control the proportion of vein contained in lamina (hereinafter referred to as the "proportion of vein or vein proportion") in consideration of the quality of product and yield to minimize the loss of lamina.

Heretofore, the proportion of vein has been controlled to an optimum value by human power. More particularly, the damper opening of winnowing means is changed according to a table of predetermined operation conditions to set a winnowing air velocity, then the operator manually holds the lamina discharged by separation, judges the proportion of vein according to the sense of touch, and when the proportion of vein is larger than a predetermined value, the damper opening is made smaller to decrease the air velocity, while when the vein proportion is smaller than the predetermined value, the damper opening is made larger to increase the air velocity.

However, if properties (area, weight, density, etc.) of the raw material which influence the separation efficiency (ratio of the lamina separated by winnowing means to the lamina fed into the winnowing means) change, the proportion of vein also changes, so it is very troublesome to determine operating conditions in advance according to the kind of raw material as in the prior art. Besides, a considerable skill is required for judging the proportion of vein according to the sense of touch, and this judgment is not so exact because of individual variations.

For the above reasons, it has heretofore been difficult to make quality control by controlling the proportion of vein.

SUMMARY OF THE INVENTION

The present invention has been effected in view of the above-mentioned circumstances. It is the object thereof to provide a system for controlling the proportion of vein in a tobacco raw material treating process, in which the wind velocity of winnowing means is set at an optimum value according to properties of a raw leaf tobacco to control the proportion of vein so as to be within the range of a predetermined value.

More specifically, the present invention is a system for controlling the proportion of vein in a tobacco raw material treating process involving feeding a raw leaf tobacco to a humidity controller to impart thereto moisture and temperature necessary for the removal of vein, then peeling off the leaf tobacco into lamina and vein by vein removing means and subsequently separating the lamina and vein from each other by winnowing means, which system includes means for measuring the flow rate of the raw leaf tobacco; means for measuring the moisture content of the leaf tobacco; sampling switching means for selecting by switching the lamina from which winnowing means in the raw material treating process is to be sampled for measuring the proportion of vein; means for measuring the proportion of vein in the lamina sampled by the sampling switching means; and arithmetic controller means for inputting the results of measurement from the flow rate measuring means and the moisture content measuring means, calculating an optimum air velocity for the winnowing means in the raw material treating process so that the proportion of vein is within the range of a preset value and controlling the winnowing means on the basis of the calculated value, and at the same time inputting as a feedback signal the result of measurement from the vein proportion measuring means and correcting the calculated value in accordance with the feedback signal.

Further, means for measuring a lamina production ratio in the raw material treating process is provided and the result of this measurement is utilized in the arithmetic controller to calculate an optimum air velocity for the winnowing means.

BRIEF DESCRIPTION OF THE DRAWINGS

An embodiment of the present invention will be described hereinunder with reference to the drawings, in which.

DETAILED DESCRIPTION OF THE EMBODIMENTS

Figure 1:
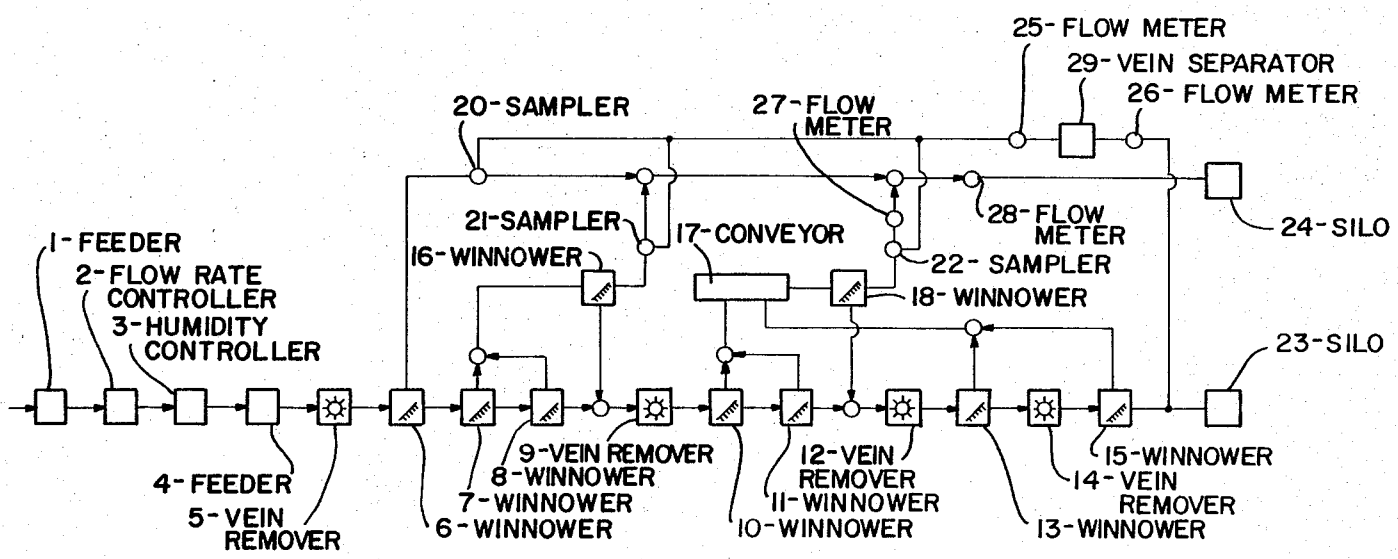
FIG. 1 is a block diagram of the entire raw material treating process.

Referring first to FIG. 1, there are shown the entirety of a raw leaf tobacco treating process and a part of the controlling system of the present invention, in which a raw leaf tobacco fed from a feeder 1 is controlled to a constant flow rate by a flow rate controller 2 and then fed to a humidity controller 3, where its humidity is adjusted with water and steam and softened to the extent required for the removal of vein. The thus-moistened leaf tobacco is peeled off into lamina and vein by vein removers 5, 9, 12 and 14, and then separated into lamina and vein by winnowers 6, 7, 8, 10, 11, 13, 15, 16 and 18. The lamina thus separated is stored in silos 23 and 24. In this case, a part of the lamina separated by the winnowers 6, 16 and 18 is sampled by samplers 20, 21 and 22 and then measured for flow rate by a flowmeter 25. Thereafter, the vein in the lamina is separated almost completely by means of a separator 29 which functions as both a vein remover and a winnower, and the amount of the vein thus separated is measured by a flowmeter 26.

In FIG. 1, the numeral 4 denotes a feeder, the numeral 17 denotes a collecting conveyor, the numeral 27 denotes a flowmeter for measuring the flow rate of lamina obtained from the line of the second- and subsequent-stage vein removers 9, 12 and 14, and the numeral 28 denotes a flowmeter for measuring the flow rate of lamina obtained from the line of all the vein removers 5, 9, 12 and 14.

Figure 2:
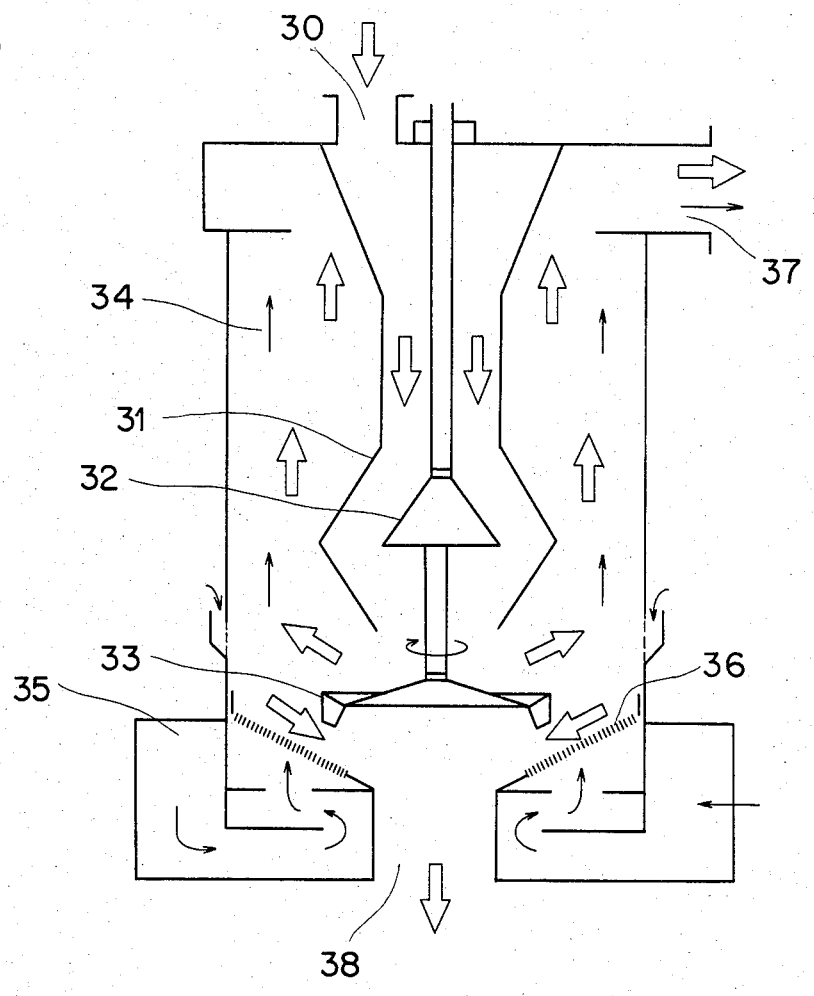
FIG. 2 is a schematic illustration of a winnower.

The winnowers 6, 7, 8, . . . are each as illustrated schematically in FIG. 2, in which the leaf tobacco which has been peeled off into lamina and vein by the vein remover 5, 9, 12 and 14 is introduced from an inlet portion 30 into an inner cylinder 31, then loosened by a first dispersing disc 32 and thereafter dispersed into a winnowing chamber 34 under a centrifugal force created by a second dispersing disc 33. A winnowing air is blown up into the winnowing chamber 34 through a grid 36 from an air chamber 35 which is formed at the lower portion of the machine, whereby the lamina is carried and discharged together with the air from a lamina outlet portion 37 formed above the winnowing chamber 34, while the vein drops to the exterior from a vein outlet portion 38 formed in the bottom of the winnowing chamber 34 without being carried by the winnowing air current.

To the winnowers 6, 16 and 18 are respectively attached motor dampers 105, 108 and 111 (see FIG. 3) as will be described later, whereby the winnowing wind velocity is adjusted automatically. As the wind velocity decreases, the amount of vein carried by the winnowing air current and discharged from the lamina outlet portion 37 together with lamina becomes smaller, but the amount of lamina dropping from the vein outlet portion 38 together with vein becomes larger. On the other hand, as the wind velocity increases, the amount of vein discharged from the lamina outlet portion 37 together with lamina becomes larger, but the amount of lamina dropping from the vein outlet portion 38 together with vein becomes smaller.

Figure 3:
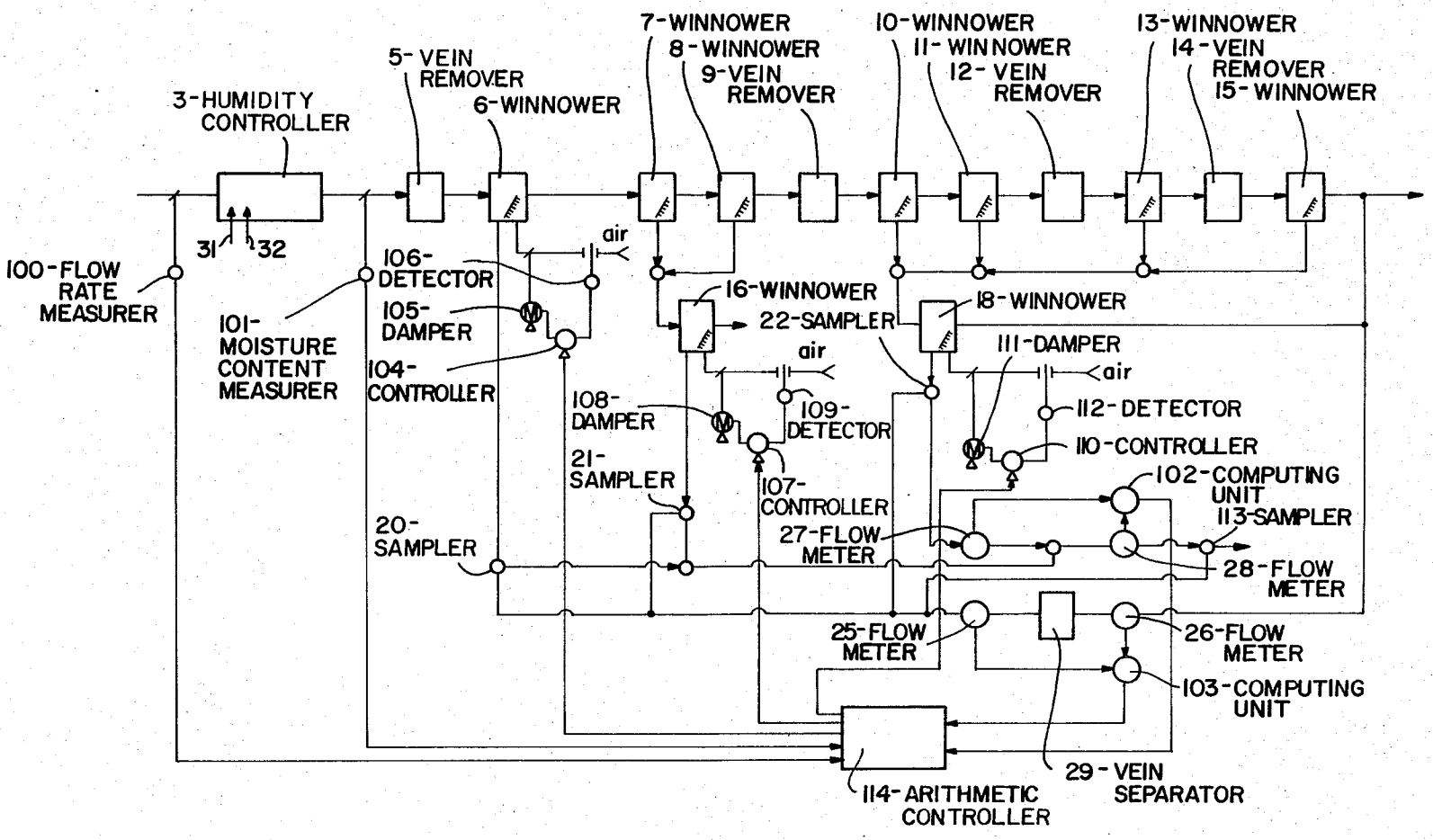
FIG. 3 is a block diagram of a controlling system.

Referring now to FIG. 3, there is shown an example of the controlling system of the present invention, in which a flow rate measuring section 100 for the raw leaf tobacco is provided on the inlet side of the humidity controller 3, while on the outlet side of the controller 3 is provided a moisture content measuring section 101.

The results of measurement in the flowmeters 27 and 28 are fed to a computing unit 102, and the ratio (lamina production ratio) of the lamina obtained in the first-stage vein remover 5 to that obtained in all the stages is calculated by the computing unit 102. The flowmeters 27 and 28 and the computing unit 102 constitute lamina production ratio measuring means, which measuring means is not so needed when the amount of vein does not greatly change at the time of change of raw leaf tobacco, but is needed when the amount of vein in raw leaf tobacco changes largely.

On the other hand, the results of measurement of the flowmeters 25 and 26 are fed to a computing unit 103, where the proportion of vein is calculated. The flowmeters 25 and 26, the computing unit 103 and the separator 29 constitute vein proportion measuring means.

The sampler 20 samples a part of the lamina separated by the winnower 6, the sampler 21 samples a part of the lamina separated by the winnower 16 which is a collecting winnower for the second and third winnowers 7 and 8 and the sampler 22 samples (about 5 kg) a part of the lamina separated by the winnower 18 which is a collecting winnower for the fourth and subsequent winnowers 10, 11, 13 and 15, then these samplers send the sampled lamina to the flowmeter 25 of the vein proportion measuring means for measuring the proportion of vein. Further, the sampler 113 samples a part of the lamina separated by all the winnowers 6, 7, 8, . . . and send it to the flowmeter 25.

The motor dampers 105, 108 and 111 attached respectively to the winnowers 6, 16 and 18 are controlled by PiD type controllers 104, 107 and 110. For example, in the winnower 6, a value of winnowing air velocity is set in the PiD controller 104 and the velocity of air fed to the winnower 6 is measured by a detector 106, then this measured value is compared with the above preset value, and if there is a deviation, the motor damper 105 is driven in accordance with a signal provided from the PiD controller 104 so that the measured value becomes coincident with the preset value. Also as to the other winnowers 16 and 18, the same control is performed on the basis of comparison between the values measured by detectors 109 and 112 and the values preset in the PiD controllers 107 and 110.

The preset values of the PiD controllers 104, 107 and 110 are calculated by an arithmetic controller 114.

The arithmetic controller 114 input signals from the flow rate measuring section 100, moisture content measuring section 101 and computing unit 102, then calculates optimum winnowing air velocities for the winnowers 6, 16 and 18 so that the proportion of vein is within the range of preset values, and outputs the calculated values as set values to the PiD type controllers 104, 107 and 110 to control the winnowers 6, 16 and 18. Further, the arithmetic controller 114 operates the samplers 20, 21, 22 and 113 in a selectively switching manner, allowing the computing unit 103 to calculate the proportion of vein in the lamina separated in the winnowers 6, 16 and 18 or in all the winnowers 6, . . . , and inputs this calculated value as a feedback signal to correct the above set values. Thus, the arithmetic controller 114 has the function of calculating optimum winnowing air velocities, the function of operating the samplers 20, 21, 22 and 113 in a selectively switching manner and the function of correcting the calculated values of optimum winnowing air velocities.

Figure 4:
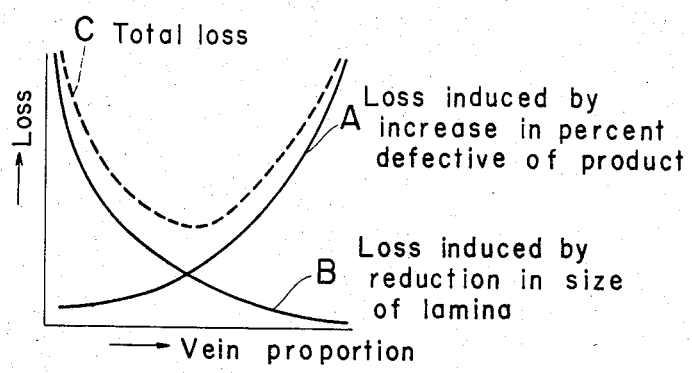
FIGS. 4*a* through 4*c* are graphs showing the relation of the vein proportion to the loss of raw material, air velocity and separation efficiency.
Figure 4:
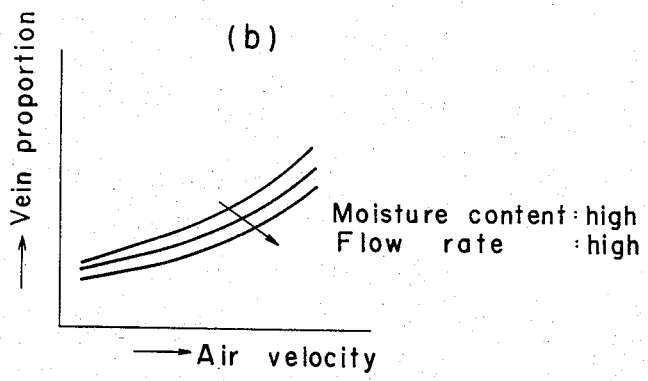
Figure 4:
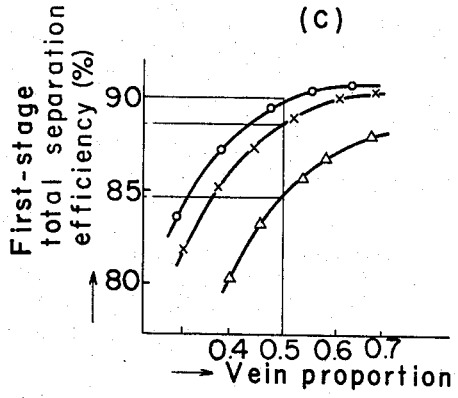

Before explaining the operation of the arithmetic controller 114 in more detail, reference is here made to FIGS. 4(*a*), (*b*) and (*c*) to explain the relation of the vein proportion to the loss of raw material, winnowing air velocity and separation efficiency. According to FIG. 4(*a*), an increase of the vein proportion causes an increase of the percent defective of product (see curve A), while a decrease thereof results in an increased ratio of lamina smaller in size and so a poor yield (see curve B). Thus, the relation between the entire loss of raw material and the proportion of vein is parabolic (see curve C), and the vein proportion at which the loss is minimum is approximately 0.5% although it differs according to properties of raw material, etc.

According to FIG. 4(*b*), an increase of the winnowing air velocity causes an increase of the vein proportion, which, however, varies according to the flow rate and moisture content of leaf tobacco; when the flow rate and the moisture content are high, the ratio of increase of the vein proportion is small, that is, even at the same winnowing air velocity the proportion of vein varies according to the flow rate and moisture content of leaf tobacco. Therefore, in order to control the vein proportion to a predetermined value, it is necessary to change the winnowing air velocity according to the flow rate and moisture content of leaf tobacco.

Further, FIG. 4(*c*) shows that the total separation efficiency of the first-stage winnower 6 changes according to combinations of vein proportions in the winnowers 6 and 16. More particularly, by controlling the vein proportion in the winnower 6 to 0.2% and that in the winnower 16 to 1.0%, the separation efficiency can be enhanced (this is called a load distribution). The final target value of the vein proportion of lamina in all the stages is set at 0.5%.

The arithmetic controller 114 sets the vein proportions in the winnowers 6, 16 and 18 at 0.2%, 1.0% and 0.5%, respectively, and thus performs a load distribution so that the final vein proportion in all the winnowers 6, 7, . . . becomes 0.5%.

Figure 5:
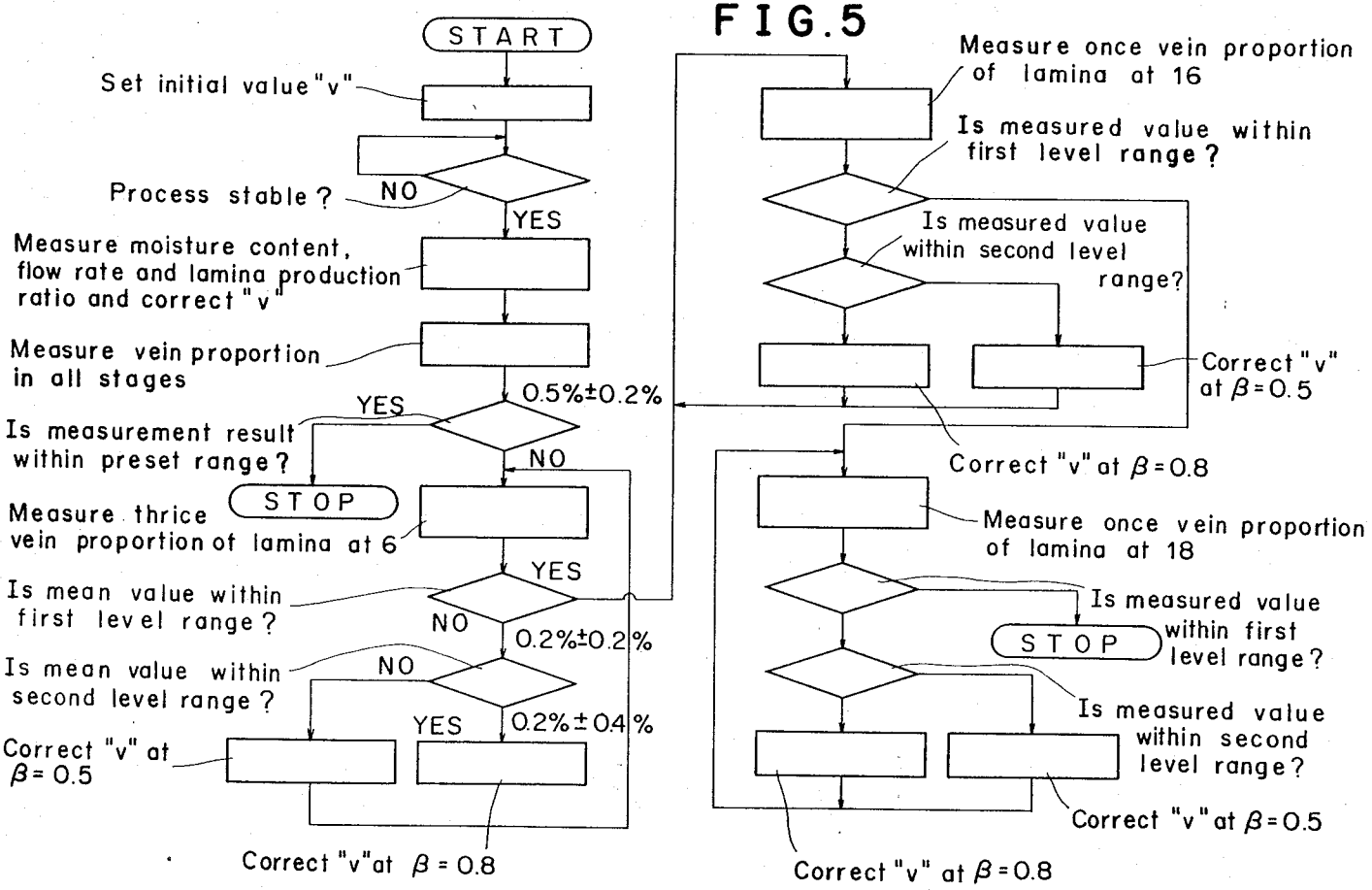
FIG. 5 is a flow chart showing operations of arithmetic controller means (arithmetic controller).

According to FIG. 5, which is a flow chart fully illustrating the operation of the arithmetic controller 114, first a temporary winnowing air velocity (initial value v) for the winnowers 6, 16 and 18 is set in the PiD type controller 104, 107 and 110.

$$v = a\,x_o + (b \pm \beta\,\Delta b)$$

where, v: set value of air velocity (m/sec)

$x_o$: target value of vein proportion (%)

a: constant determined by winnowers 6, . . . , a fixed value b: constant determined by moisture content, flow rate and lamina production ratio, a variable value $\beta$: correction coefficient based on feedback of vein proportion $\Delta b$: constant determined according to the kind of raw material, a fixed value On the basis of the above initial value "v" the raw material treating process is operated. Upon reaching a stable state, the arithmetic controller 114 inputs signals from the flow rate measuring section 100, moisture content measuring section 101 and computing unit 102, then calculates "b" in the above equation and corrects the initial value "v". Thus, the initial value "v" is corrected according to properties (area, weight, density, amount of vein) of raw leaf tobacco.

After the correction, upon reaching a stable state, the sampler 113 is operated to sample a part of the lamina separated in all the winnowers 6, 7, . . . , and the proportion of vein is measured twice. Then, judgment is made as to whether the mean of the twice measured values is within the range of the final target value 0.5%±0.2%. If it is within this range, the operation of the arithmetic controller 114 is over.

On the other, if the answer is negative, the sampler 20 is operated to sample a part of the lamina separated by the winnower 6, and the proportion of vein is measured three times. Then, judgment is made as to whether the mean of the thrice measured values is within the range of a first level, 0.2%±0.2%, of the final target value (0.2%). If it is outside this range judgment is made as to whether it is within the range of a second level of 0.2%±0.4%. If it is within this range, $\beta$ in the foregoing equation is set at 0.5 and the winnowing air velocity, v, is corrected. On the other hand, if it is outside the range of the second level, the winnowing air velocity, v, is corrected at $\beta=0.8$, then the vein proportion of the lamina separated by the winnower 6 is again measured three times and the same operation as above is repeated.

If the mean of the thrice measured values is within the range of the aforesaid first level, 0.2%±0.2%, the sampler 21 is operated to sample a part of the lamina separated by the winnower 16, and the proportion of vein is measured once.

Then, judgment is made as to whether the measured value is within the range of a first level, 1.0%±0.2%, of the final target value (1.0%). If it is outside this range, judgment is made as to whether it is within the range of a second level of 1.0%±0.4%. If the answer is affirmative, $\beta$ in the foregoing equation is set at 0.5 and the winnowing air velocity, v, is corrected. On the other hand, if the answer is negative, the winnowing air velocity, v, is corrected at $\beta=0.8$, then the vein proportion of the lamina separated by the winnower 16 is measured and the same operation as above is repeated.

If the measured value is within the range of the first level 1.0%±0.2%, the sampler 22 is operated to sample a part of the lamina separated by the winnower 18, and the proportion of vein is measured once.

Then, judgment is made as to whether the measured value is within the range of a first level, 0.5%±0.2%, of the final target value (0.5%). If it is outside this range, judgment is made as to whether it is within the range of a second level of 0.5%±0.4%. If the answer is affirmative, $\beta$ in the foregoing equation is set at 0.5 and the winnowing air velocity, v, is corrected. On the other hand, if the answer is negative, the winnowing air velocity, v, is corrected at $\beta=0.8$, then the vein proportion of the lamina separated by the winnower 18 is measured and the same operation as above is repeated. And if the measured value is within the range of the first level of 0.5%±0.2%, the arithmetic controller 114 stops operation.

In this way, the arithmetic controller 114 on the one hand determines optimum winnowing air velocity values for the winnowers 6, 16 and 18 and on the other hand inputs vein proportions as feedback signals to correct the optimum values. Therefore, the system can immediately cope with a change in properties of raw leaf tobacco.

Moreover, the loss of raw material can be kept to a minimum and the separation efficiency can be improved.

In the above embodiment, the load distribution was made at different vein proportions in the winnowers 6, 16 and 18, that is, the vein proportions in the winnowers 6, 16 and 18 were set at 0.2%, 1.0% and 0.5%, respectively. But, all the winnowers may be set at the same vein proportion if only the final vein proportion of lamina becomes a preset value (e.g. 0.5%).

Moreover, although the winnowers 6, 16 and 18 were controlled, the object of control is not limited thereto. For example, only the winnower 6 may be controlled. The winnower 6 as the first-stage winnower separates about 75% of the entire lamina, so even if it alone is controlled, it is possible to fully control the vein proportion. To attain a quick response, it is preferable that only the first-stage winnower 6 be controlled. In this case, in the flow chart of FIG. 5, if the vein proportion (mean of thrice measured values) of the lamina separated by the winnower 6 is within the range of the first level, 0.2%±0.2%, of the final target value (0.2%), the arithmetic controller 114 stops operation and performs no subsequent operations.

Both winnowers 6 and 16 may be controlled. In this case, in the flow chart of FIG. 5, if the vein proportion (once measured value) of the lamina separated by the winnower 16 is within the range of the first level, 0.1%±0.2%, of the final target value (1.1%), the arithmetic controller 114 stops operation and performs no subsequent operations.

Further, although the lamina production ratio measuring means composed of the flowmeters 27 and 28 and the computing unit 102 was provided in the foregoing embodiment, when the amount of vein contained in leaf tobacco does not greatly change, the proportion of vein can be controlled to a constant level even without using such lamina production ratio measuring means.

As set forth hereinabove, the vein proportion controlling system of the present invention includes means for measuring the flow rate of raw leaf tobacco; means for measuring the moisture content of the leaf tobacco moistened by a humidity controller; sampling switching means (arithmetic controller 114) for selecting by switching the lamina from which winnower in the raw material treating process is to be sampled for measuring the proportion of vein; and arithmetic controller means (arithmetic controller 114) for inputting the results of measurement from the flow rate measuring means and the moisture content measuring means, calculating an optimum air velocity for the winnowing means in the raw material treating process so that the proportion of vein is within the range of a preset value and controlling the winnowing means on the basis of the calculated value, and at the same time inputting as a feedback signal the result of measurement from the vein proportion measuring means and correcting the calculated value in accordance with the feedback signal. Therefore, the system can immediately cope with a change in properties of raw material and control the proportion of vein to a constant level, thus permitting not only the improvement of yield but also the reduction of percent defective of product. Further, the separation efficiency and the operating efficiency of the winnowers can be improved.

Thus, according to the present invention, the quality control can be easily attained by controlling the vein proportion to a constant level.

Moreover, by providing the lamina production ratio measuring means, the proportion of vein can be controlled to a constant level even when the amount of vein contained in raw leaf tobacco largely changes.

What is claimed is:

1. A system for controlling the proportion of leaf vein in leaf lamina produced in a tobacco leaf treating system having a humidity controller for adjusting the temperature and moisture content of raw leaf tobacco to levels necessary for the removal of leaf vein, means for feeding the raw leaf tobacco into said humidity controller, means for removing leaf vein from leaf lamina, and winnowing means for separating the removed leaf vein and the leaf lamina, said winnowing means having means for blowing air at predetermined velocities in said winnowing means, said control system comprising:

means for measuring the flow rate of the raw leaf tobacco into said treating system;

means for measuring the moisture content of the raw leaf tobacco from said humidity controller;

means for selectively sampling the lamina output of said winnowing means;

means for measuring the proportion of leaf vein in the lamina samples;

arithmetic controlling means for inputting the flow rate determined by said flow rate measuring means and the moisture content determined by said moisture content measuring means and calculating an optimum air velocity for said winnowing means so that the leaf vein proportion is within a certain range of a predetermined value, said arithmetic controlling means including feedback means for simultaneously inputting the leaf vein proportion determined by said leaf vein proportion measuring means and, based thereon, adjusting the calculated optimum air velocity; and, means for regulating the air velocity in said winnowing means based on the calculated optimum air velocity.

2. A system for controlling the proportion of leaf vein in leaf lamina produced in a tobacco leaf treating system as recited in claim 1, wherein:

said winnowing means includes first stage winnowing means and second stage winnowing means;

said arithmetic controlling means inputs the flow rate determined by said flow rate measuring means and the moisture content determined by said moisture content measuring means and calculates optimum air velocities for said first and second stage winnowing means so that the leaf vein proportions of the lamina from said first and second stage winnowing means respectively are within certain ranges of predetermined values, the predetermined values being different from one another;

said air velocity regulating means includes means for regulating the air velocities in said first and second winnowing means based on the calculated optimum air velocities; and, said feedback means inputs the leaf vein proportions determined by said leaf vein proportion measuring means and, based thereon, adjusts the calculated optimum air velocities.

3. A system for controlling the proportion of leaf vein in leaf lamina produced in a tobacco leaf treating system as recited in claim 2, wherein:

the predetermined value of the leaf vein proportion for the lamina from said first stage winnowing means is set at 0.2% and the predetermined value from said second stage winnowing means is set at 1.0%; and, said arithmetic controlling means also calculates the optimum air velocities so that the final leaf vein proportion of the lamina from all said winnowing means is within a certain range of a predetermined value set at approximately 0.5%.

4. A system for controlling the proportion of leaf vein in leaf lamina produced in a tobacco leaf treating system having a humidity controller for adjusting the temperature and moisture content of raw leaf tobacco to levels necessary for the removal of leaf vein, means for feeding the raw leaf tobacco into said humidity controller, first and second stage means for removing leaf vein from leaf lamina, and winnowing means for separating the removed leaf vein and the leaf lamina, said winnowing means having means for blowing air at predetermined velocities in said winnowing means, said control system comprising:

means for measuring the flow rate of the raw leaf tobacco into said treating system;

means for measuring the moisture content of the raw leaf tobacco from said humidity controller;

means for measuring the production ratio of lamina produced by said first stage removing means to the lamina produced by all said removing means;

means for selectively sampling the lamina output of said winnowing means;

means for measuring the proportion of leaf vein in the lamina samples;

arithmetic controller means for inputting the flow rate determined by said flow rate measuring means, the moisture content determined by said moisture content measuring means, and the lamina production ratio determined by said lamina production ratio measuring means and calculating an optimum air velocity for said winnowing means so that the leaf vein proportion is within a certain range of a predetermined value, said arithmetic controller means including feedback means for simultaneously inputting the leaf vein proportion determined by said leaf vein proportion measuring means and, based thereon, adjusting the calculated optimum air velocity; and, means for regulating the air velocity in said winnowing means based on the calculated optimum air velocity.

5. A system for controlling the proportion of leaf vein in leaf lamina produced in a tobacco leaf treating system as recited in claim 4, wherein:

said winnowing means includes first stage winnowing means and second stage winnowing means;

said arithmetic controller means inputs the flow rate determined by said flow rate measuring means, the moisture content determined by said moisture content measuring means, and the lamina production ratio determined by said lamina production ratio measuring means, and calculates optimum air velocities for said first and second stage winnowing means so that the leaf vein proportions of the lamina from said first and second stage winnowing means respectively are within certain ranges of predetermined values, the predetermined values being different from one another;

said air velocity regulating means includes means for regulating the air velocities in said first and second winnowing means based on the calculated optimum air velocities; and, said feedback means inputs the leaf vein proportions determined by said leaf vein proportion measuring means and, based thereon, adjusted the calculated optimum air velocities.

6. A system for controlling the proportion of leaf vein in leaf lamina produced in a tobacco leaf treating system as recited in claim 5, wherein:

the predetermined value of the leaf vein proportion for the lamina from said first stage winnowing means is set at 0.2% and the predetermined value from said second stage winnowing means is set at 1.0%; and, said arithmetic controller means also calculates the optimum air velocities so that the final leaf vein proportion of the lamina from all said winnowing means is within a certain range of a predetermined value set at approximately 0.5%.

* * * * *